United States Patent [19]

Mori et al.

[11] Patent Number: 4,985,394

[45] Date of Patent: Jan. 15, 1991

[54] THERMOSENSITIVE RECORDING MATERIAL

[75] Inventors: Yasutomo Mori, Numazu; Norio Kurisu, Susono, both of Japan

[73] Assignee: Ricoh Company, Ltd., Tokyo, Japan

[21] Appl. No.: 450,238

[22] Filed: Dec. 13, 1989

[30] Foreign Application Priority Data

Dec. 28, 1988 [JP] Japan ..... 63-331020

[51] Int. Cl.[5] ..... B41M 5/18

[52] U.S. Cl. ..... 503/226; 427/152; 503/200; 503/207

[58] Field of Search ..... 427/150–152; 428/40, 913, 911; 503/200, 207, 226

[56] References Cited

FOREIGN PATENT DOCUMENTS 1197277 9/1986 Japan ..... 428/914

*Primary Examiner*—Pamela R. Schwartz

*Attorney, Agent, or Firm*—Oblon, Spivak, McClelland, Maier & Neustadt

[57] ABSTRACT

A thermosensitive recording material is disclosed, which comprises a substrate, a thermosensitive coloring layer comprising a leuco dye and a color developer capable of inducing color formation in the leuco dye, formed on the substrate, and a protective layer comprising at least one inorganic pigment selected from the group consisting of silica and calcium carbonate, each having an average particle diameter of 0.1 μm or less, and a water-soluble binder, formed on the thermosensitive coloring layer.

6 Claims, No Drawings

THERMOSENSITIVE RECORDING MATERIAL

BACKGROUND OF THE INVENTION

1. Field of the Invention

The present invention relates to a thermosensitive recording material, in particular, to a thermosensitive recording material having a surface glossiness of 50% or more {GS (75°)} in accordance with Japanese Industrial Standards (JIS)-P-8142 and excellent matching properties to a thermal head.

2. Discussion of Background

A thermosensitive recording material, which is one of recording materials, is constructed in such a manner that a thermosensitive coloring layer capable of forming color images under application of heat is formed on a substrate such as a sheet of paper, synthetic paper or a resin film. The thermosensitive recording material is used in a thermal printer equipped with a thermal head, which supplies the thermal energy to the above thermosensitive recording material to form images thereon. This image recording method by use of the thermosensitive recording material has many advantages over other conventional recording methods. For example, the image recording by the thermosensitive recording material does not necessitate development and image-fixing processes, the image recording can be performed by a relatively simple mechanism in a short time, and the manufacturing cost of the thermosensitive recording material itself is low. Therefore those thermosensitive recording materials are utilized not only in copying machines, but also in facsimile apparatus, ticket vending apparatus and label recorders.

Conventional thermosensitive recording materials, however, are not necessarily perfect in every respect. More specifically, a thermofusible material contained in the thermosensitive recording material is melted and adheres to a thermal head in the course of image-recording, which induces a sticking phenomenon, causes the thermal head to wear away, and impairs the quality of recorded images.

In particular, when the thermosensitive recording material is used as a ticket or label paper, the reliability of recorded images is not stable and the resistance to water, plasticizers and oils is not sufficient. In addition to the above, when the thermosensitive recording material is practically used as a ticket or label paper, its printabilities, such as ink receptivity and ink adhesion, are inferior to those of plain paper.

The above-mentioned problems have been solved to some degree, but not completely, by providing a protective layer on the thermosensitive coloring layer in the thermosensitive recording material. The protective layer generally comprises a resin, a pigment, a lubricant or a surface active agent.

In the formation of the protective layer in the thermosensitive recording material, finely-divided particles of an inorganic pigment such as silica, calcium carbonate, aluminum hydroxide, titanium oxide, barium sulfate, zinc hydroxide, clay, talc, surface-treated calcium and surface-treated silica, each having an average particle diameter of 0.5 μm to 4 μm; and finely-divided particles of an organic pigment such as urea - formaldehyde resin and polyethylene resin, each having an average particle diameter of about 0.5 μm, are conventionally employed.

As a water-soluble binder for use in the protective layer, water-soluble polymers such as polyvinyl alcohol, modified polyvinyl alcohol, cellulose derivatives, sodium polyacrylate, polyvinyl pyrrolidone, acrylamide - acrylic acid ester copolymer, acrylamide - acrylic acid ester - methacrylic acid terpolymer, alkali salts of styrene - maleic anhydride copolymer, alkali salts of isobutylene - maleic anhydride copolymer, polyacrylamide, gelatin and casein; emulsions such as polyvinyl acetate, polyurethane, polyacrylic acid, polyacrylic acid ester, vinyl chloride - vinyl acetate copolymer, polybutylmethacrylate and ethylene - vinyl acetate copolymer; and latexes such as styrene - butadiene copolymer and styrene - butadiene - acrylic acid derivatives copolymer are conventionally employed Metallic salts of aliphatic acids such as zinc stearate, aluminum stearate, calcium stearate, zinc palmitate and zinc behenate are used as a lubricant for use in the protective layer.

When the protective layer of the thermosensitive recording material comprises the above-mentioned binder agent, pigment and lubricant, the matching properties of the recording material to a thermal head (hereinafter referred to as the thermal-head matching properties), reliability of recorded images and printability can be quite improved, but not perfectly.

However, the surface glossiness of the conventional thermosensitive recording materials attains 1 to 20% {GS (75°)} in accordance with JIS-P-8142, even when the mixing ratio of the above components is controlled with the utmost care so as to maintain the necessary thermal-head matching properties, reliability of recorded images and printability, or the conditions of supercalendering for surface-treatment are improved.

Recently, there is a tendency to impart a high-grade impression to thermosensitive recording products, such as a label or ticket sheet using the thermosensitive recording material. There is a demand for a thermosensitive recording material having high surface glossiness. However, in the above-mentioned conventional thermosensitive recording material comprising a protective layer, it is difficult to obtain a sufficient glossiness because the protective layer contains pigment particles.

In Japanese Laid-Open Patent Application No. 61-262177, there is proposed a thermosensitive recording material in which a protective layer comprising finely-divided particles of calcium carbonate having an average particle diameter of 6 μm or less is provided on a thermosensitive coloring layer. The thermosensitive recording material proposed in this application, however, is not directed to the improvement of the surface glossiness of the recording material, but to the mere improvement of the thermal-head matching properties thereof.

To obtain sufficient surface glossiness of the thermosensitive recording material, there is proposed a method of further coating an ultraviolet-curing resin on the protective layer. However, this method has another product quality problem of the occurrence of cracking or crazing in the surface thereof, and the manufacturing cost is high.

SUMMARY OF THE INVENTION

Accordingly, an object of the present invention is to provide a thermosensitive recording material free from the above-mentioned conventional shortcomings, which has a surface glossiness of 50% or more {GS (75°)} in accordance with JIS-P-8142.

The above-mentioned object of the present invention can be achieved by a thermosensitive recording material comprising a substrate, a thermosensitive coloring layer comprising a leuco dye and a color developer capable of inducing color formation in the leuco dye upon application of heat thereto, formed on the substrate, and a protective layer comprising at least one of silica and calcium carbonate, each having an average particle diameter of 0.1 μm or less, and a water-soluble binder, formed on the thermosensitive coloring layer.

DETAILED DESCRIPTION OF THE PREFERRED EMBODIMENTS

The thermosensitive recording material according to the present invention comprises a substrate, a thermosensitive coloring layer comprising a leuco dye and a color developer capable of inducing color formation in the leuco dye upon application of heat thereto, and a protective layer which contains an inorganic pigment of silica and/or calcium carbonate, each having an average particle diameter of 0.1 μm or less, and a water-soluble binder. Because of this structure, not only the thermal-head matching properties of the recording material, the reliability of recorded images and printability can be improved, but also a surface glossiness of as high as 50% or more {GS (75°)} in accordance with JIS-P-8142 can be attained.

Examples of the water-soluble binders for use in the protective layer are water-soluble binders such as polyvinyl alcohol, modified polyvinyl alcohol, cellulose derivatives, sodium polyacrylate, polyvinyl pyrrolidone, acrylamide - acrylic acid ester copolymer, acrylamide - acrylic acid ester - methacrylic acid terpolymer, alkali salts of styrene - maleic anhydride copolymer, alkali salts of isobutylene - maleic anhydride copolymer, polyacrylamide, gelatin and casein; emulsions such as polyvinyl acetate, polyurethane, polyacrylic acid, polyacrylic acid ester, vinyl chloride - vinyl acetate copolymer, polybutylmethacrylate and ethylene - vinyl acetate copolymer; and latexes such as styrene - butadiene copolymer and styrene - butadiene - acrylic acid derivative copolymer.

In the protective layer for use in the present invention, aziridine compounds, epoxy compounds, ethyleneimine compounds and epichlorohydrin compounds are used as a crosslinking agent, which serves as a water-resisting agent.

In the present invention, an intermediate layer comprising, for example, a resinous material may be interposed between the thermosensitive coloring layer and the protective layer, an undercoat layer comprising, for example, a resinous material may be interposed between the substrate and the thermosensitive coloring layer, and a backing layer may be attached to the back side of the substrate opposite to the thermosensitive coloring layer.

In the thermosensitive coloring layer for use in the present invention, leuco dyes can be used alone or in combination. As the leuco dyes for use in the present invention, any conventional leuco dyes used in conventional thermosensitive recording materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-(N,N-diethylamino)-5-methyl-7-(N,N-dibenzylamino)fluoran,
Benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-methyl-N-isopropylamino)-6-methyl-7-anilino-fluoran,
3-dibutylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylamino-fluoran,
2-[3,6-bis(diethylamino)-9-(o-chloroanilino)xanthylbenzoic acid lactam],
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilino-fluoran,
3-diethylamino-6-methyl-7-anilinofluoran,
3-N-ethyl-N-tetrahydrofurfurylamino-6-methyl-7-anilinofluoran, 3-diethylamino-6-methyl-7-mesidino-4',5'-benzofluoran,
3-N-methyl-N-isobutyl-6-methyl-7-anilinofluoran,
3-N-ethyl-N-isoamyl-6-methyl-7-anilinofluoran, and
3-diethylamino-6-methyl-7-(2',4'-dimethylanilino)-fluoran.

As the color developers for use in the present invention, various electron acceptors, such as phenolic compounds, thiophenolic compounds, thiourea derivatives, and organic acids and metallic salts thereof, which are capable of inducing color formation in the aforementioned leuco dye, are employed.

Specific examples of such color developers are as follows:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methylphenol,
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoic acid,
2-hydroxy-1-naphthoic acid,
1-hydroxy-2-naphthoic acid,
zinc hydroxynaphthoate,
aluminum hydroxynaphthoate,
calcium hydroxynaphthoate,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
3,3'-diallyl-4,4'-diphenolsulfone,
3,4-dihydroxyphenyl-4'-methylphenylsulfone,
$\alpha,\alpha$-bis(4-hydroxyphenyl)-$\alpha$-methyltoluene,
antipyrine complex of zinc thiocyanate,
tetrabromobisphenol A, and
tetrabromobisphenol S.

To obtain a thermosensitive recording material according to the present invention, a variety of conventional binder agents can be employed for binding the above-mentioned leuco dyes and color developers to a substrate of the thermosensitive recording material.

Examples of the binder agents used in the thermosensitive coloring layer are water-soluble polymers such as polyvinyl alcohol, starch, starch derivatives, cellulose derivatives such as hydroxymethylcellulose, hydroxyethylcellulose, carboxymethylcellulose, methylcellulose and ethylcellulose, sodium polyacrylate, polyvinyl pyrrolidone, acrylamide - acrylic acid ester copolymer, acrylamide - acrylic acid ester - methacrylic acid terpolymer, alkali salts of styrene - maleic anhydride copolymer, alkali salts of isobutylene - maleic anhydride copolymer, polyacrylamide, sodium alginate, gelatin and casein; emulsions such as polyvinyl acetate, polyurethane, polyacrylic acid, polyacrylic acid ester, vinyl chloride - vinyl acetate copolymer, polybutylmethacrylate and ethylene - vinyl acetate copolymer; and latexes such as styrene - butadiene copolymer and styrene - butadiene - acrylic acid derivative copolymer.

Further in the present invention, auxiliary additive components which are used in the conventional thermosensitive recording materials, such as a filler, a surface active agent, and a thermofusible material (or a lubricant) can be employed together with the above-mentioned leuco dyes and color developers in the thermosensitive coloring layer.

Examples of the fillers used in the thermosensitive coloring layer are finely-divided particles of inorganic fillers such as calcium carbonate, silica, zinc oxide, titanium oxide, aluminum hydroxide, zinc hydroxide, barium sulfate, clay, talc, surface-treated calcium, and surface-treated silica; and finely-divided particles of organic fillers such as urea - formaldehyde resin, styrene - methacrylic acid copolymer, and polystyrene resin.

Examples of the thermofusible materials used in the thermosensitive coloring layer are aliphatic acids such as stearic acid and behenic acid; amides of aliphatic acids such as stearic acid amide and palmitic acid amide; metallic salts of aliphatic acids such as zinc stearate, aluminum stearate, calcium stearate, zinc palmitate and zinc behenate; and p-benzylbiphenyl, terphenyl, triphenylmethane, benzyl p-benzyloxybenzoate, $\beta$-benzyloxynaphthalene, $\beta$-phenyl naphthoate, 1-hydroxy-2-phenyl naphthoate, 1-hydroxy-2-methyl naphthoate, diphenyl carbonate, dibenzyl terephthalate, dimethyl terephthalate, 1,4-dimethoxynaphthalene, 1,4-diethoxynaphthalene, 1,4-dibenzyloxynaphthalene, 1,2-bis(phenoxy)ethane, 1,2-bis(3-methylphenoxy)ethane, 1,2-bis(4-methylphenoxy)ethane, 1,4-bis(phenoxy)butane, 1,4-bis(phenoxy)-2-butene, 1,2-bis(4-methoxyphenylthio)ethane, dibenzoylmethane, 1,4-bis(phenylthio)butane, 1,4-bis(phenylthio)-2-butene, 1,2-bis(4-methoxyphenylthio)ethane, 1,3-bis(2-vinyloxyethoxy)benzene, 1,4-bis(2-vinyloxyethoxy)benzene, p-(2-vinyloxyethoxy)-biphenyl, p-allyloxybiphenyl, p-propargyloxybiphenyl, dibenzoyloxymethane, 1,3-dibenzoyloxypropane, dibenzyl disulfide, 1,1-diphenyl ethanol, 1,1-diphenyl propanol, p-(benzyloxy)benzyl alcohol, 1,3-diphenoxy-2-propanol, N-octadecylcarbamoyl-p-methoxycarbonylbenzene, and N-octadecylcarbamoylbenzene.

Other features of this invention will become apparent in the course of the following description of exemplary embodiments, which are given for illustration of the invention and are not intended to be limiting thereof.

EXAMPLE 1

(Preparation of Thermosensitive Coloring layer)

Liquid A and Liquid B were separately prepared by dispersing the following respective components in a ball mill for 24 hours:

| | Parts by Weight |
|---|---|
| [Liquid A] | |
| 3-dibutylamino-6-methyl-7-anilinofluoran | 60 |
| 5% aqueous solution of hydroxyethylcellulose | 60 |
| Water | 180 |
| [Liquid B] | |
| Bisphenol A | 60 |
| 5% aqueous solution of hydroxyethylcellulose | 60 |
| Water | 150 |
| Calcium carbonate | 30 |

One part by weight of Liquid A and 4 parts by weight of Liquid B were mixed, so that a thermosensitive coloring layer coating liquid was prepared. The thus prepared thermosensitive coloring layer coating liquid was coated on a sheet of commercially available high quality paper having a basis weight of 52 g/m$^2$, with a deposition of 5 g/m$^2$ on a dry basis, and then dried, whereby a thermosensitive coloring layer was formed on the substrate.

(Preparation of Protective Layer)

Liquid C-1 was prepared by dispersing the following components in a ball mill for 5 hours:

| [Liquid C-1] | Parts by Weight |
|---|---|
| 10% aqueous solution of polyvinyl alcohol | 20 |
| 20% aqueous solution of glyoxal-modified polyacrylic acid | 1 |
| Calcium carbonate (having an average particle diameter of 0.05 μm) | 20 |
| 30% dispersion of zinc stearate | 1 |
| Water | 58 |

The thus prepared protective layer coating liquid was coated on the above-mentioned thermosensitive coloring layer with a deposition of 2 g/m$^2$ on a dry basis, and then dried, whereby a protective layer was formed on the thermosensitive coloring layer. Thus, a thermosensitive recording material No. 1 according to the present invention was obtained.

EXAMPLE 2

The procedure for the preparation of the thermosensitive recording material employed in Example 1 was repeated except that the protective layer coating liquid, Liquid C-1 employed in Example 1 was replaced by Liquid C-2 with the following formulation, whereby a thermosensitive recording material No. 2 according to the present invention was obtained.

| [Liquid C-2] | Parts by Weight |
|---|---|
| 10% aqueous solution of polyvinyl alcohol | 20 |
| 20% aqueous solution of glyoxal-modified polyacrylic acid | 1 |
| Silica (having an average particle diameter of 0.05 μm) | 20 |
| 30% dispersion of zinc stearate | 1 |
| Water | 58 |

-continued

COMPARATIVE EXAMPLE 1

The procedure for the preparation of the thermosensitive recording material employed in Example 1 was repeated except that the protective layer coating liquid, Liquid C-1 employed in Example 1 was replaced by Liquid CC-1 with the following formulation, whereby a comparative thermosensitive recording material No. 1 was obtained.

| [Liquid CC-1] | Parts by Weight |
|---|---|
| 10% aqueous solution of polyvinyl alcohol | 20 |
| 20% aqueous solution of glyoxal-modified polyacrylic acid | 1 |
| Calcium carbonate (having an average particle diameter of 0.2 μm) | 20 |
| 30% dispersion of zinc stearate | 1 |
| Water | 58 |

COMPARATIVE EXAMPLE 2

The procedure for the preparation of the thermosensitive recording material employed in Example 1 was repeated except that the protective layer coating liquid, Liquid C-1 employed in Example 1 was replaced by Liquid CC-2 with the following formulation, whereby a comparative thermosensitive recording material No. 2 was obtained.

| [Liquid CC-2] | Parts by Weight |
|---|---|
| 10% aqueous solution of polyvinyl alcohol | 20 |
| 20% aqueous solution of glyoxal-modified polyacrylic acid | 1 |
| Calcium carbonate (having an average particle diameter of 3 to 4 μm) | 20 |
| 30% dispersion of zinc stearate | 1 |
| Water | 58 |

COMPARATIVE EXAMPLE 3

The procedure for the preparation of the thermosensitive recording material employed in Example 1 was repeated except that the protective layer coating liquid, Liquid C-1 employed in Example 1 was replaced by Liquid CC-3 with the following formulation, whereby a comparative thermosensitive recording material No. 3 was obtained.

| [Liquid CC-3] | Parts by Weight |
|---|---|
| 10% aqueous solution of polyvinyl alcohol | 20 |
| 20% aqueous solution of | 1 |

-continued

| [Liquid CC-3] | Parts by Weight |
|---|---|
| glyoxal-modified polyacrylic acid | |
| Silica (having an average particle diameter of 0.2 μm) | 20 |
| 30% dispersion of zinc stearate | 1 |
| Water | 58 |

The surface glossiness of each of the thermosensitive recording materials No. 1 and No. 2 according to the present invention and the comparative thermosensitive recording materials No. 1 to No. 3 was measured in accordance with JIS-P8142.

Furthermore, the thermosensitive recording materials were subjected to a printing test using a commercially available label printer, "Model B-22" (Trademark), made by TEC. The thermal-head matching properties of each thermosensitive recording material were evaluated using the label printer, in view of the presence or absence of dusts which adhered to the thermal head and the occurrence of the sticking phenomenon.

The results are given in Table 1.

TABLE 1

| Thermosensitive Recording Material No. | Protective Layer Coating Liquid | Surface Glossiness (%) | Thermal-head Matching Properties |
|---|---|---|---|
| Thermosensitive Recording Material No. 1 | C-1 | 85 | Excellent |
| Thermosensitive Recording Material No. 2 | C-2 | 70 | Excellent |
| Comparative Thermosensitive Recording Material No. 1 | CC-1 | 25 | Excellent |
| Comparative Thermosensitive Recording Material No. 2 | CC-2 | 8 | Excellent |
| Comparative Thermosensitive Recording Material No. 3 | CC-3 | 10 | Excellent |

As can be seen from the results shown in Table 1, the thermosensitie recording materials No. 1 and No. 2 according to the present invention were superior to the comparative thermosensitive recording materials No. 1 to No. 3 with respect to the surface glossiness, and the thermal head matching properties of the thermosensitive recording materials No. 1 and No. 2 according to the present invention were as excellent as those of the comparative thermosensitive recording materials No. 1 to No. 3. In addition to the above, the printabilities of the thermosensitive recording materials of the present invention were proved to be excellent in UV printing and flexography.

What is claimed is:

1. A thermosensitive recording material comprising: (a) a substrate, (b) a thermosensitive coloring layer comprising a leuco dye and a color developer capable of inducing color formation in said leuco dye, formed on the substrate, and (c) a protective layer comprising (i) at least one inorganic pigment selected from the group consisting of silica and calcium carbonate, each having an average particle diameter of 0.1 μm or less, and (ii) a water-soluble binder, formed on said thermosensitive coloring layer.

2. The thermosensitive recording material as claimed in claim 1, wherein said protective layer further comprises a water-resisting agent.

3. The thermosensitive recording material as claimed in claim 1, further comprising an intermediate layer interposed between said thermosensitive coloring layer and said protective layer.

4. The thermosensitive recording material as claimed in claim 1, further comprising an undercoat layer interposed between said substrate and said thermosensitive, coloring layer.

5. The thermosensitive recording material as claimed in claim 1, further comprising a backing layer on the back side of said substrate opposite to said thermosensitive coloring layer

6. The thermosensitive recording material as claimed in claim 1, wherein said water-soluble binder for use in said protective layer is a polymer, selected from the group consisting of polyvinyl alcohol, cellulose, sodium polyacrylate, polyvinyl pyrrolidone, acrylamide - acrylic acid ester copolymer, acrylamide - acrylic acid ester - methacrylic acid terpolymer, alkali salts of styrene - maleic anhydride copolymer, alkali salts of isobutylene - maleic anhydride copolymer, polyacrylamide, gelatin, casein; polyvinyl acetate, polyurethane, polyacrylic acid, polyacrylic acid ester, vinylchloride - vinyl acetate copolymer, polybutylmethacrylic - ethylene vinyl acetate copolymer, styrene - butadiene copolymer and styrene - butadiene - acrylic acid terpolymer.

* * * * *